US005164539A

United States Patent [19]

French

[11] Patent Number: 5,164,539

[45] Date of Patent: Nov. 17, 1992

[54] PROJECTILE CARRIER

[75] Inventor: Kendrick L. French, Lebanon, Me.

[73] Assignee: K. W. Thompson Tool Company, Inc., Rochester, N.H.

[21] Appl. No.: 786,050

[22] Filed: Oct. 31, 1991

[51] Int. Cl.[5] ..... F42B 14/06

[52] U.S. Cl. ..... 102/520; 42/90; 102/442; 102/511; 102/532

[58] Field of Search ..... 102/520, 521, 522, 532, 102/511, 442; 42/51, 90

[56] References Cited

U.S. PATENT DOCUMENTS 2,306,140 12/1942 Reed ..... 102/520
3,762,332 10/1973 Witherspoon et al. ..... 102/520
3,894,492 7/1975 Barr et al. ..... 102/520
4,175,493 11/1979 Daily ..... 102/520

FOREIGN PATENT DOCUMENTS 123501 2/1919 United Kingdom ..... 102/522

*Primary Examiner*—Charles T. Jordan
*Attorney, Agent, or Firm*—Blodgett & Blodgett

[57] ABSTRACT

A projectile carrier for use for the muzzle loading firearm. The carrier is formed of two separate and identical halves which abut along a common vertical plane. The two halves of the carrier when combined form a circular bottom wall and a cylindrical side wall which extends upwardly from the bottom wall. The side wall has a top opening for receiving a projectile.

14 Claims, 2 Drawing Sheets

FIG. 12
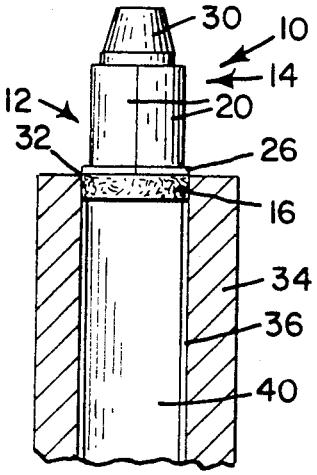
FIG. 13
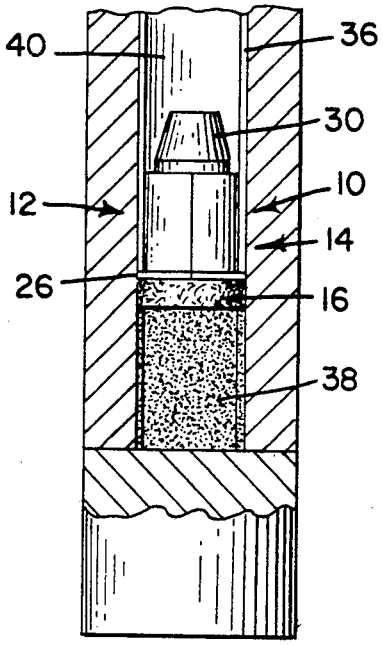
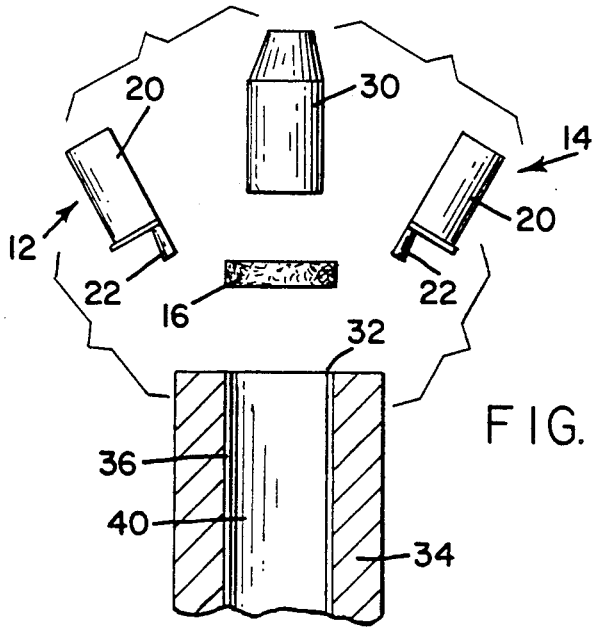
FIG. 14

PROJECTILE CARRIER

BACKGROUND OF THE INVENTION

The present invention relates generally to a projectile carrier which positions a missile or projectile in a gun barrel. The invention relates particularly to a projectile carrier known as a sabot. A sabot is a thrust-transmitting projectile carrier that positions a missile or projectile in a gun barrel and that prevents the escape of gas ahead of the projectile. Sabot's are particularly useful for enabling a modern jacketed pistol or rifle bullet to be used in a muzzle loading firearm. The sabot improves gas sealing, projectile velocity and projectile accuracy. Sabots which are in current use consist of a plastic cup like element which has a circular bottom or base wall and a cylindrical side wall which extends outwardly from the base wall and which terminates in a top opening. The projectile is inserted into the sabot through the top openings so that is resets against the base wall. The side wall of the sabot typically has a plurality of longitudinal slots which divide the side wall into a plurality of spaced fingers. The projectile is inserted within the confines of the side wall of the sabot so that the base of the projectile rests against the bottom or base wall of the sabot. During use of the sabot, powder is poured into the barrel of the firearm. The projectile bearing sabot is pushed into the muzzle of the firearm and pushed down into the barrel to the powder charge. When the firearm is fired, the sabot and projectile are propelled outwardly along the barrel and out through the muzzle of the firearm. Under ideal conditions, the projectile and the sabot separate after they emerge from the muzzle of the firearm. However, separation of the sabot and projectile does not always occur immediately after emergence from the muzzle or the firearm. The longer that the sabot and projectile remain together after firing, the more that the velocity and accuracy of the projectile is adversely affected. These and other difficulties experienced with the prior art sabots have been obviated by the present invention.

It is, therefore, a principal object of the invention to provide a projectile carrier or sabot for use with a muzzle loading firearm which separates from the projectile as soon as the sabot and projectile clear the muzzle of the firearm when the firearm is fired.

Another object of this invention is the provision of a projectile carrier or sabot for use with a muzzle loading firearm which cleans the inside surface of the barrel as it travels along the barrel.

A further object of the present invention is the provision of a projectile carrier or sabot for use with a muzzle loading firearm which provides a seal above the powder charge.

It is another object of the present invention to provide a projectile carrier or sabot for a muzzle loading firearm which lubricates the barrel of the firearm.

A still further object of the invention is the provision of a split or two-part sabot which is temporarily held together by a retaining element until the sabot and projectile clear the muzzle of the firearm after the firearm is fired.

With these and other objects in view, as will be apparent to those skilled in the art, the invention resides in the combination of parts set forth in the specification and covered by the claims appended hereto.

SUMMARY OF THE INVENTION

The invention consists of a sabot or projectile carrier for use with a muzzle loading firearm which has a circular bottom wall and a cylindrical side wall which extends upwardly from the bottom wall and which terminates at a top opening for receiving the projectile. The sabot is split longitudinally into two separate identical halves which are temporarily held together until the carrier and projectile emerge from the muzzle of the firearm when the firearm is fired. More specifically, each half of the carrier has a projection which together form a retaining pin which extends through a central opening in a circular lubricant impregnated wad which rests against the bottom wall of the carrier and which serves to temporarily hold the halves of the carrier together.

BRIEF DESCRIPTION OF THE DRAWINGS

The character of the invention, however, may be best understood by reference to one of its structural forms, as illustrated by the accompanying drawings, in which:

FIGS. 9–14 illustrate the steps of assembling the projectile carrier and utilizing the projectile carrier in a muzzle loading firearm.

DESCRIPTION OF THE PREFERRED EMBODIMENT

Figure 1:
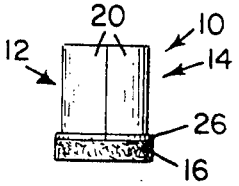
FIG. 1 is a front elevational view of a projectile carrier or sabot embodying the principles of the present invention.
Figure 2:
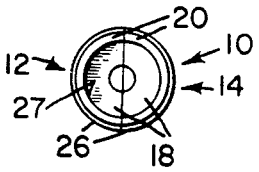
FIG. 2 is a top plan view of the projectile carrier.
Figure 3:
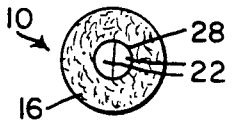
FIG. 3 is a bottom plan view of the projectile carrier.
Figure 4:
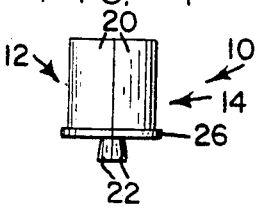
FIG. 4 is a front elevational view of a projectile carrier without the wad which forms part of the carrier.
Figure 5:
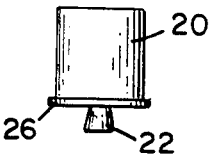
FIG. 5 is a side elevational view of the outer side of one of the half portions of the projectile carrier.
Figure 6:
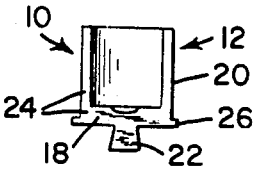
FIG. 6 is a side elevational view of the inner side of one half portion of the projectile carrier.
Figure 7:
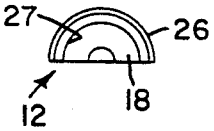
FIG. 7 is a top plan view of one half portion of the projectile carrier.
Figure 8:
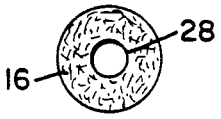
FIG. 8 is a top plan view of the wad portion of the projectile carrier.

Referring to FIGS. 1–6, the projectile carrier of the present invention is generally indicated by the reference numeral 10 and comprises two identical half portions, a first half portion generally indicated by the reference numeral 12 and a second half portion which is generally indicated by the reference number 14. The half portions 12 and 14 are held together by a circular wad 16 of fibrous material such as wool which is impregnated with a lubricant.

Each half portion 12 and 14 has a semi-circular bottom wall 18 a semi-cylindrical side wall 20 which extends upwardly from the bottom wall 18 and a projection 22 which extends downwardly from the bottom wall. Each half of the carrier has an inner edge surface 24 which lies in a vertical plane and abuts the corresponding edge surface 24 of the other half of the carrier. When the two halves 12 and 14 are joined as shown in FIGS. 1–4, the side wall 20 forms a complete cylindrical wall. The flanges 26 form an annular flange about the cylindrical wall and the projections 22 form a frusto conical retaining pin. The circular wad 16 has a central aperture 28. The wad 16 rests against the bottom surface of the bottom or base wall 18 so that the projections 22 extend through the aperture 28 to retain the wad against the bottom wall. At the same time, the two halves 12 and 14 of the projectile carrier are tenuously held together by the wad 16.

Figure 9:
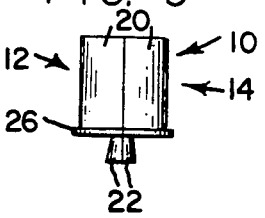
Figure 10:
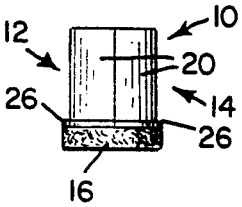
Figure 11:
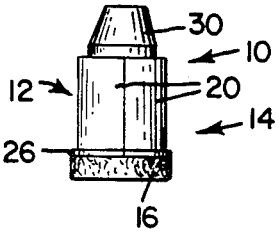

The projectile carrier 10 of the present invention is utilized by first combining the two identical halves 12 and 14 so that the inner edge surfaces 24 abut along a common plane as shown in FIG. 9. The wad 16 is then applied to the bottom wall so that the projections 22 extend through the aperture 28 as shown in FIG. 10. A jacketed projectile 30 is then inserted into the cylindrical chamber which is formed by the two halves 12 and 14 through the top opening 27 so that the bottom of the projectile rests against the bottom wall 18 and the top of the projectile extends above the top opening 27 as shown in FIG. 11. The projectile carrier 10 and its projectile charge 30 are now ready for use in a muzzle loading firearm.

With the barrel of a muzzle loading firearm in an upright position, a measured charge of powder is poured into the barrel. The combined projectile carrier 10 and its projectile charge 30 is then positioned at the muzzle 32 of the barrel 34 as shown in FIG. 12. The barrel 34 has a bore 40 and rifling 36 along the surface of the bore. The carrier and projectile are then pushed down into the barrel until the wad 16 reaches the top of the powder charge which is indicated by the reference number 38 in FIG. 13. The diameter of the flange 26 is equal to the diameter of the wad 16 and this diameter is equal to the outside diameter of the rifling 36. The wad 16 is impregnated with a lubricant so that the movement of the wad within the barrel during the loading step and the firing step lubricates the bore of the barrel. At the same time, the flange 26 scrapes and cleans the barrel of powder residue during its movement along the bore of the barrel. The wad 16 provides a tight seal to maintain the powder charge 38 in place as the firearm is manipulated for shooting. When the powder charge 38 is ignited as part of the firing of the firearm, the wad 16 and flange 26 form a seal to maintain the discharged gases behind the carrier 10 as the carrier and projectile are driven out of the barrel to maintain maximum firing power. As the carrier and projectile emerge from the muzzle 32, the high initial wind resistance causes the carrier halves 12 and 14 to separate as shown in FIG. 14. This enables the projectile to be completely clear of the carrier so that it is uninhibited by the carrier and its trajectory is unaffected.

The wad cushions the initial shock of the explosion behind the sabot so that the initial shock to the projectile is not as harsh or as hard. This results in a more consistent discharge of the projectile with a resulting consistent firing accuracy.

Clearly, minor changes may be made in the form and construction of the invention without departing from the material spirit thereof. Therefore, it is not desired to confine the invention to the exact form shown herein and described but it is desired to include all subject matter which properly comes within the scope claimed.

The invention then having been thus described what is claimed as new and desired to secure by letters patent is:

1. A projectile carrier for use with a muzzle loading firearm which includes a barrel having a bore, said projectile carrier comprising:
   (a) a circular bottom wall,
   (b) a cylindrical side wall which extends upwardly from said bottom wall, said side wall having a top opening for receiving a projectile, and
   (c) an annual outer flange which extends beyond said outer cylindrical surface for scraping and cleaning the bore of the barrel during loading and discharge of the firearm.

2. A projectile carrier as recited in claim 1, wherein said carrier further comprises:
   (a) a disc of lubricant adsorbing material, and
   (b) connecting means for removably mounting said disc against the bottom surface of said bottom wall.

3. A projectile carrier as recited in claim 2, wherein said disc is a compressible and resilient wad of fibrous material.

4. A projectile carrier for use with a muzzle loading firearm which includes a barrel having a bore, said projectile carrier comprising:
   (a) a circular bottom wall,
   (b) a cylindrical side wall which extends upwardly from said bottom wall, said side wall having a top opening for receiving a projectile,
   (c) a disc of lubricant adsorbing material, and
   (d) connecting means for removably mounting said disc against the bottom surface of said bottom wall so that the bore of the barrel is lubricated by said disc during loading and discharge of the firearm.

5. A projectile carrier as recited in claim 4, wherein said disc is a compressible and resilient wad of fibrous material.

6. A projectile carrier for use with a muzzle loading firearm comprising:
   (a) a first half element which has a first semi-circular horizontal base and a first semi-cylindrical side wall which extends upwardly from said base, said base having a vertical edge surface, said side wall having a pair of spaced vertical edge surfaces which lie in the same vertical plane as the vertical edge surface, of said base,
   (b) a second half element which has a second semi-circular base and a second cylindrical side wall which extends upwardly from said second base, said second base having a second vertical edge surface, said second side wall having a pair of spaced vertical edges surfaces which lie in the same vertical plane as the vertical edge surface of said second base, the vertical edges surfaces of said first half element abutting the vertical edge surfaces of said second half element to form a cylindrical projectile holding cap having a circular bottom wall which has a bottom surface, a cylindrical side wall and a circular top opening,
   (c) a disc of lubricant adsorbing material, and
   (d) connecting means for removably mounting said disc against the bottom surface of said bottom wall.

7. A projectile carrier as recited in claim 6, wherein said connecting means comprises:
   (a) a projection which extends downwardly from the bottom surface of each of said first and second half elements, said projections abutting and together forming a retaining pin, and
   (b) a central aperture in said disc for receiving said retaining pin so that said first and second half elements are tenuously held together by said disc.

8. A projectile carrier as recited in claim 7, wherein said retaining pin has a frusto-conical shape which tapers outwardly and downwardly from said bottom wall.

9. A projectile carrier as recited in claim 6, wherein said disc is a compressible and resilient wad of fibrous material.

10. A projectile carrier for use with a muzzle loading firearm comprising:

(a) a first half element which has a first semi-circular horizontal base and a first semi-cylindrical side wall which extends upwardly from said base, said base having a vertical edge surface, said side wall having a pair of spaced vertical edge surfaces which lie in the same vertical plane as the vertical edge surface, of said base, and (b) a second half element which has a second semi-circular base and a second cylindrical side wall which extends upwardly from said second base, said second base having a second vertical edge surface, said second side wall having a pair of spaced vertical edge surfaces which lie in the same vertical plane as the vertical edge surface of said second base, the vertical edge surfaces of said first half element abutting the vertical edge surfaces of said second half element to form a cylindrical projectile holding cap having a circular bottom wall, a cylindrical side wall and a circular top opening, said cylindrical side wall having an outer cylindrical surface and said circular bottom wall having an annular outer flange which extends beyond said outer cylindrical surface.

11. A projectile carrier for use with a muzzle loading firearm comprising:

(a) a circular bottom wall which has a bottom surface, (b) a cylindrical side wall which extends upwardly from said bottom wall, said side wall having a top opening for receiving a projectile, said projectile carrier being formed of two separate and identical halves which abut along a common vertical plane, (c) a circular wad of fibrous material, and (d) connecting means for removably mounting said wad against the bottom surface of said bottom wall.

12. A projectile carrier as recited in claim 11, wherein said connecting means comprises:

(a) a projection which extends downwardly from the bottom surface of each half of said projectile carrier, said projections abutting along said common vertical plane and together forming a retaining pin, and (b) a central aperture in said wad for receiving said retaining pin so that said projectile carrier halves are tenuously held together by said wad.

13. A projectile carrier as recited in claim 12, wherein said retaining pin has a frusto-conical shape which tapers outwardly and downwardly from said bottom wall.

14. A projectile carrier for use with a muzzle loading firearm comprising:

(a) a circular bottom wall, (b) a cylindrical side wall which extends upwardly from said bottom wall, said side wall having an outer cylindrical surface, a top opening for receiving a projectile, said projectile carrier being formed of two separate and identical halves which abut along a common vertical plane, and (c) an annular outer flange which extends from said bottom wall beyond said outer cylindrical surface.

* * * * *